US012484690B2

(12) United States Patent
Jacob et al.

(10) Patent No.: US 12,484,690 B2
(45) Date of Patent: Dec. 2, 2025

(54) MASCARA BRUSH HAVING TORNADO-SHAPED BRISTLE

(71) Applicant: SHYA HSIN PACKAGING INDUSTRY (CHINA) CO., LTD., Kunshan (CN)

(72) Inventors: Christophe Jacob, Kunshan (CN); Fuhai Yu, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 348 days.

(21) Appl. No.: 17/852,410

(22) Filed: Jun. 29, 2022

(65) Prior Publication Data

US 2023/0263296 A1 Aug. 24, 2023

(30) Foreign Application Priority Data

Feb. 18, 2022 (CN) ..... 202210153362.9

(51) Int. Cl.
*A46B 9/02* (2006.01)
*A46D 1/00* (2006.01)

(52) U.S. Cl.
CPC ..... *A46B 9/021* (2013.01); *A46B 9/026* (2013.01); *A46B 9/028* (2013.01); *A46D 1/0238* (2013.01); *A46B 2200/1053* (2013.01)

(58) Field of Classification Search
CPC ..... A46B 9/021; A46B 9/026; A46B 9/028; A46B 2200/1046; A46B 2200/1053;
(Continued)

(56) References Cited

U.S. PATENT DOCUMENTS 2,227,126 A * 12/1940 Cooke ..... A46B 9/04 451/914
2,876,477 A * 3/1959 Stewart ..... A46B 9/04 15/159.1

(Continued)

FOREIGN PATENT DOCUMENTS

CN 1282557 A 2/2001
CN 102098944 A 6/2011

(Continued)

OTHER PUBLICATIONS

Ile, "DE 202020003336 U1 translated" (Year: 2020).*
Viegas, Manuel "FR 2937514 A1 translated" (Year: 2010).*

*Primary Examiner* — Thomas C Barrett
*Assistant Examiner* — Holly T. To
(74) *Attorney, Agent, or Firm* — Bayramoglu Law Offices LLC

(57) ABSTRACT

A mascara brush having a tornado-shaped bristle includes a bristle and a core. A root of the bristle is provided on the core, and a free end of the bristle is provided away from the core. There is at least one bristle. A centerline of the bristle intersects with an axis of the core in a non-perpendicular manner. By providing an included angle between the centerline of the bristle and the axis of the core, the bristle is inserted between eyelashes more easily. As the bristle is not perpendicular to the axis of the core, a cross section of the whole mascara brush is reduced. While the length of the bristle remains the same, the opening of a mascara bottle is reduced. The new mascara brush has the advantages of better application effect, more compact structure and better ease of eyelash combing.

17 Claims, 7 Drawing Sheets

(58) Field of Classification Search
CPC ..... A46B 2200/106; A46B 9/06; A46B 3/18; A46B 3/005; A46D 1/0238; A46D 1/0253; A46D 1/02; A46D 1/0276; A46D 1/0292; A46D 1/0269; A45D 40/265
USPC ..... D28/7; D4/128; 15/207.2; 132/218
See application file for complete search history.

(56) References Cited

U.S. PATENT DOCUMENTS 3,031,730 A * 5/1962 Morin ..... B29C 67/0044 24/444
3,344,457 A * 10/1967 Grobert ..... A46D 1/0238 D25/120
D260,949 S * 9/1981 Megna ..... 15/207.2
4,493,125 A * 1/1985 Collis ..... A46B 9/04 15/110
4,504,998 A * 3/1985 Price ..... A46D 1/00 15/186
5,020,551 A * 6/1991 Guerret ..... A46B 3/18 15/207.2
6,094,769 A * 8/2000 Driesen ..... A46D 1/0238 428/397
6,161,243 A * 12/2000 Weihrauch ..... D01D 5/253 264/177.17
6,219,875 B1 * 4/2001 Medynski ..... A46B 9/04 15/167.1
6,390,708 B1 * 5/2002 Gueret ..... A46D 1/0246 401/121
6,623,200 B1 * 9/2003 Gueret ..... A45D 34/046 15/207.2
D581,674 S * 12/2008 Dumler ..... D4/136
D593,330 S * 6/2009 Berhault ..... D4/136
7,654,270 B2 * 2/2010 Gueret ..... A46D 1/0253 15/207.2
D632,485 S * 2/2011 Bigio ..... D4/128
D662,715 S * 7/2012 Kulik ..... D4/136
D664,362 S * 7/2012 Kulik ..... D4/128
8,662,090 B2 * 3/2014 Gueret ..... A45D 40/265 132/218
9,402,461 B2 * 8/2016 Brik ..... A46B 9/04
9,723,911 B2 * 8/2017 Gueret ..... A46D 1/0207
10,111,516 B1 * 10/2018 Kim ..... A46B 3/20
10,477,958 B2 * 11/2019 Xi ..... A46D 1/006
D990,894 S * 7/2023 Yang ..... D4/133
D1,008,666 S * 12/2023 De Bardonneche ..... D4/128
D1,081,156 S * 7/2025 Yu ..... D4/128
2004/0117930 A1 * 6/2004 Townley ..... A46B 9/026 15/28
2004/0237236 A1 * 12/2004 Gavney, Jr. ..... A47L 1/06 15/117
2004/0240926 A1 * 12/2004 Gueret ..... A46D 1/04 15/207.2
2006/0080799 A1 * 4/2006 Lucente ..... A46D 1/00 15/207.2
2009/0194128 A1 * 8/2009 Vandromme ..... A46B 3/18 15/207.2
2010/0071715 A1 * 3/2010 Bickford ..... A46B 9/021 132/218
2012/0170965 A1 * 7/2012 Kulik ..... A46D 1/0253 401/121
2012/0192892 A1 * 8/2012 Kulik ..... A46B 9/021 132/218
2013/0036565 A1 * 2/2013 Gueret ..... A45D 40/267 15/160
2013/0133692 A1 * 5/2013 Withers ..... A61B 1/122 15/207.2
2013/0315647 A1 * 11/2013 Gueret ..... A46B 9/021 401/122
2014/0016985 A1 * 1/2014 Osvaldo ..... A46D 1/0253 132/218
2015/0033486 A1 * 2/2015 Chiou ..... A46B 9/04 15/167.1
2015/0093174 A1 * 4/2015 Schreiber ..... A46B 9/021 401/122
2017/0027303 A1 * 2/2017 Rutigliano ..... A46D 1/0238
2017/0281209 A1 * 10/2017 Ramos-Medina ... A61B 17/244
2018/0104727 A1 * 4/2018 Lokkinen ..... A46B 13/003
2018/0140083 A1 * 5/2018 Berhault ..... A46B 5/0079
2018/0213923 A1 * 8/2018 Corbellini ..... A46B 9/021
2019/0104839 A1 * 4/2019 Mark ..... A46B 9/04
2019/0350353 A1 * 11/2019 Borsari ..... A46D 1/0207
2023/0263297 A1 * 8/2023 Jacob ..... A46B 9/021 15/159.1
2024/0197065 A1 * 6/2024 Kouicem ..... A46B 1/00
2024/0206621 A1 * 6/2024 Yu ..... A46B 9/026

FOREIGN PATENT DOCUMENTS

CN 102326952 A 1/2012
CN 102802463 A 11/2012
CN 114698923 A 7/2022
DE 202020003336 U1 * 12/2020 ..... A46B 9/021
FR 2937514 A1 * 4/2010 ..... A45D 40/262
JP 2009291344 A 12/2009

* cited by examiner

MASCARA BRUSH HAVING TORNADO-SHAPED BRISTLE

CROSS REFERENCE TO THE RELATED APPLICATIONS

This application is based upon and claims priority to Chinese Patent Application No. 202210153362.9, filed on Feb. 18, 2022, the entire contents of which are incorporated herein by reference.

TECHNICAL FIELD

The present disclosure relates to applicators, and in particular to a mascara brush having a tornado-shaped bristle.

BACKGROUND

Existing mascara brushes are undesirable because material is loaded onto bristles in small amounts at one time. When combing eyelashes, the bristles must be to dipped in the material repeatedly, which is time-consuming. Material from the bristles are poorly adhered to the eyelashes, and there is residue remaining on the bristles after each use. In addition, it is also difficult to insert the bristles between the eyelashes and to comb the eyelashes.

SUMMARY

In view of the above defects, the present disclosure provides a mascara brush having a tornado-shaped bristle. The mascara brush having a tornado-shaped bristle has the advantages of better application effect, more compact structure and better ease of eyelash combing.

To solve the technical problems, the present disclosure employs the following technical solutions: A mascara brush having a tornado-shaped bristle includes a bristle and a core. A root of the bristle is provided on the core, and a free end of the bristle is provided away from the core. There is at least one bristle. A centerline of the bristle intersects with an axis of the core in a non-perpendicular manner.

Optionally, the centerline of the bristle may be an arc line. Included angles between all the bristles and the axis of the core may be identical in a direction. The core may be rod-like. A single row of bristles may be spaced apart along the axis of the core, or multiple rows of bristles may be spaced apart along the axis of the core and spaced apart in a tornado-shaped manner along a circumferential direction of the core. Two adjacent rows of bristles may be parallel to each other or staggered from each other along the axis of the core.

Optionally, at least two rows of bristles may be provided on the core, where at least one row of bristles may be the bristles formed into the included angles with the axis of the core, and centerlines of remaining ones of the bristles may be perpendicular to the axis of the core.

Optionally, an included angle between the centerline of the bristle and the axis of the core may be in a range of greater than 0° to equal or less than 45°.

Optionally, two sides of the same row of bristles may be defined as a first side and a second side, respectively. The bristle at the first side may have a height of H1, the bristle at the second side may have a height of H2, and the bristle in a middle may have a height of H3, where H1=H2>H3, or H1>H2>H3, or H2>H1>H3.

Optionally, centerlines of at least two of the bristles may be gathered to one point, or gathered to a circumference of one circle.

Optionally, a cross section of the bristle may be in at least one of a square shape, a cross shape, an I shape, a petaloid shape, an octagon, a rectangle, a rounded rectangle, a triangle, a convex trapezoid, a concave trapezoid, a circle and an ellipse.

Optionally, a cross section of the bristle may be in at least one of a square shape, a cross shape, an I shape, a petaloid shape, an octagon, a rectangle, a rounded rectangle, a triangle, an ellipse, a convex trapezoid and a concave trapezoid. The bristle may be twisted along a circumferential direction of its own axis. At least one of the free end, the root or a middle portion of the bristle may be twisted.

Optionally, when the bristle is in any one of the cross shape, the I shape and the octagon, a groove formed by a concave portion on the cross section of the bristle may be a spiral groove.

Optionally, the cross-sectional shapes at different heights of the same bristle may be identical or similar.

Optionally, the cross section of the bristle may be in a centrosymmetric shape or an axisymmetric shape.

Optionally, a cross-sectional area of the bristle from the root to a tip may be decreased linearly.

Optionally, the bristle may be twisted clockwise along the circumferential direction of its own axis, or twisted counterclockwise along the circumferential direction of its own axis.

Optionally, side edges of the bristle may be located at outward protruding junctions between two lines of the cross section of the bristle. At least one of the side edges of the bristle may be twisted.

Optionally, all the side edges of the bristle may be twisted; any two of the side edges may be twisted in different angles; or any two of the side edges in a centrosymmetry may be twisted in a same angle.

Optionally, the bristle and the core may be formed by integrated injection molding.

The present disclosure has the following beneficial effects: The mascara brush having a tornado-shaped bristle includes a bristle and a core. A root of the bristle is provided on the core, and a free end of the bristle is provided away from the core. There is at least one bristle. A centerline of the bristle intersects with an axis of the core in a non-perpendicular manner. By providing an included angle between the centerline of the bristle and the axis of the core, the bristle is inserted between eyelashes more easily. As the bristle is not perpendicular to the axis of the core, a cross section of the whole mascara brush is reduced. While the length of the bristle remains the same, the opening of a mascara bottle is reduced. The present disclosure has the advantages of better application effect, more compact structure and better ease of eyelash combing.

1: bristle, and 2: core.

DETAILED DESCRIPTION OF THE EMBODIMENTS

In order to understand the technical means of the present disclosure more clearly and implement the technical means according to contents in the specification, specific implementations of the present disclosure will be further described below in detail with reference to the accompanying drawings and embodiments. The embodiments described below are intended to illustrate the present disclosure, rather than limit the scope of the present disclosure.

Embodiment 1

Figure 1:
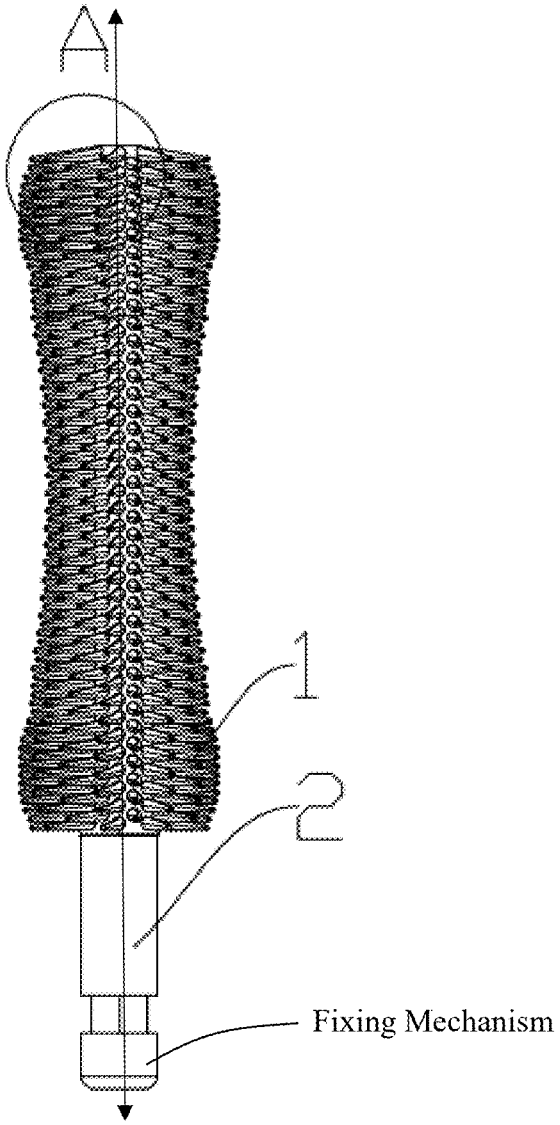
FIG. 1 is a front view of a mascara brush having a tornado-shaped bristle according to Embodiment 1 of the present disclosure.
Figure 2:
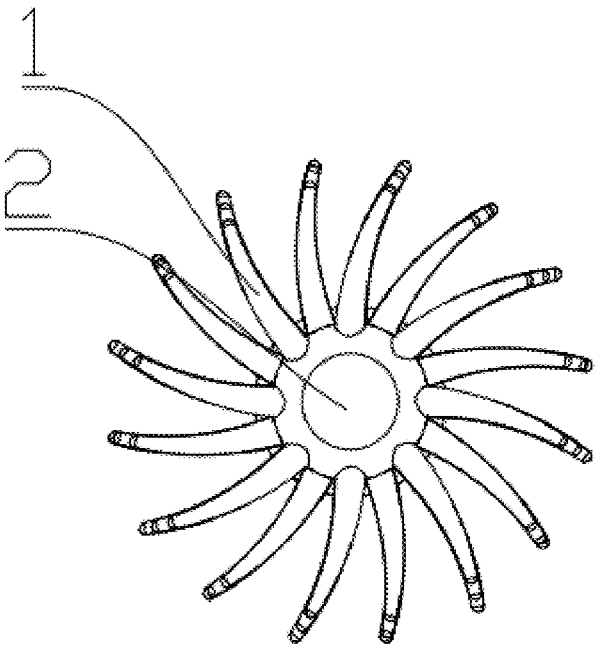
FIG. 2 is a top view of a mascara brush having a tornado-shaped bristle according to Embodiment 1 of the present disclosure.
Figure 3:
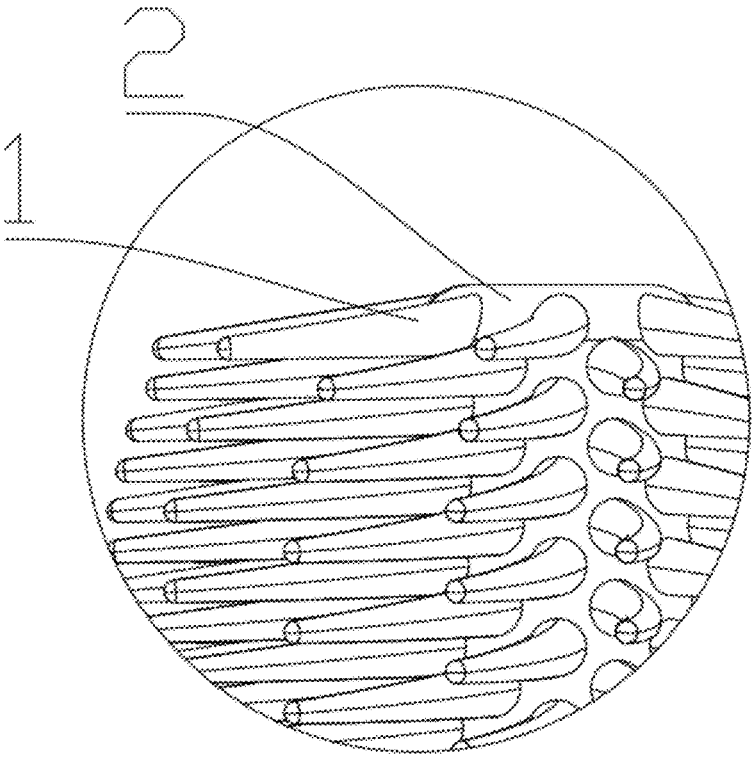
FIG. 3 is an enlarged view of a position A in FIG. 1.
Figure 4:
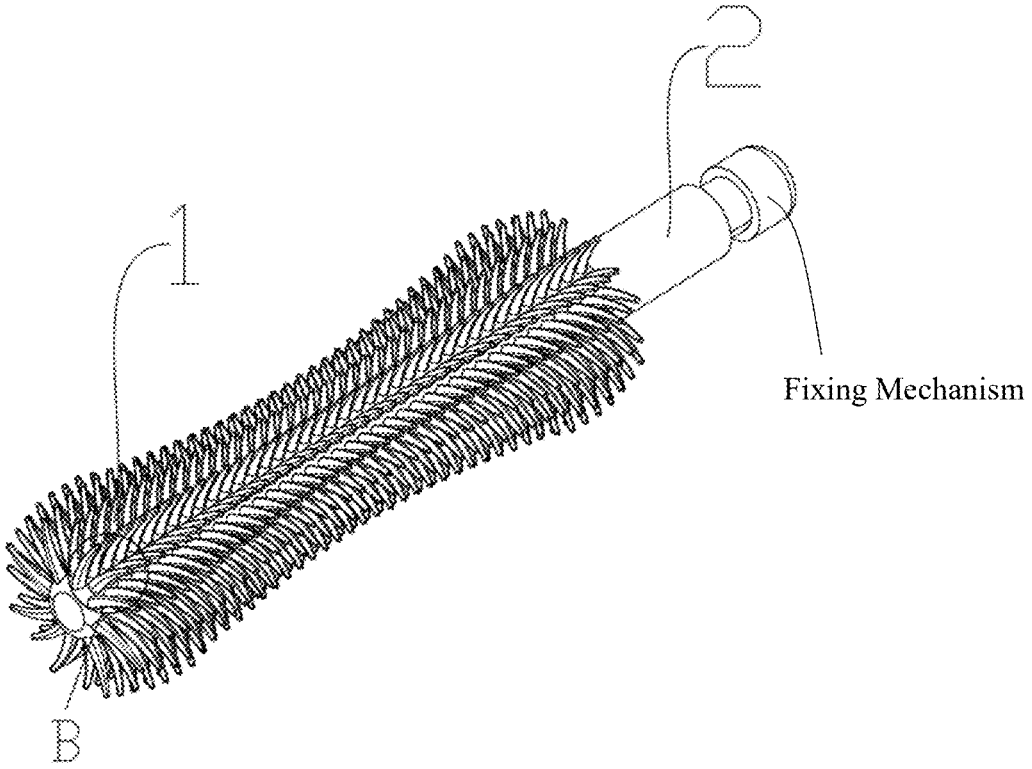
FIG. 4 is a stereoscopic view of a mascara brush having a tornado-shaped bristle according to Embodiment 1 of the present disclosure.
Figure 5:
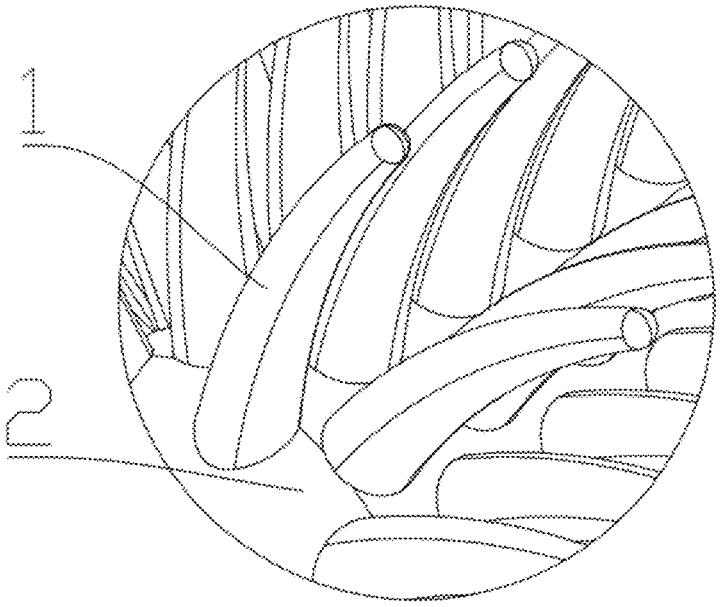
FIG. 5 is an enlarged view of a position B in FIG. 4.
Figure 6:
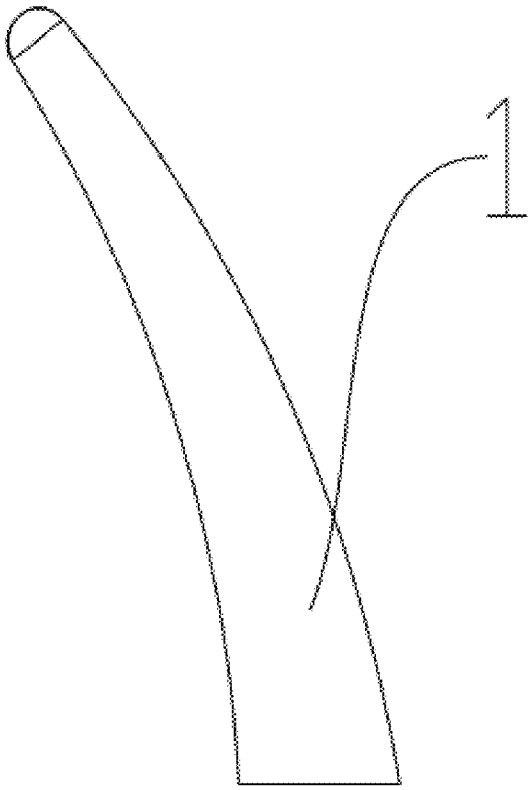
FIG. 6 is a front view of a bristle according to Embodiment 1 of the present disclosure.
Figure 7:
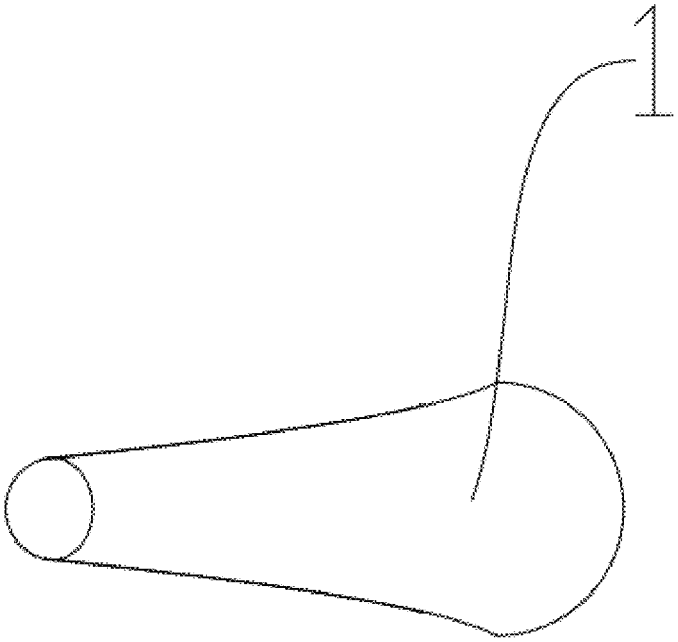
FIG. 7 is a top view of a bristle according to Embodiment 1 of the present disclosure.

As shown in FIGS. 1-7, the present disclosure provides a mascara brush having a tornado-shaped bristle, including a bristle 1 and a core 2. A root of the bristle 1 is provided on the core 2, and a free end of the bristle 1 is provided away from the core 2. There is at least one bristle 1. A centerline of the bristle 1 intersects with an axis of the core 2 in a non-perpendicular manner. In the embodiment, the centerline of the bristle 1 is oblique to the axis of the core 2. The positional relationship between the bristle 1 and the core 2 is an exemplary illustration, rather than a specific limitation to the present disclosure.

In a specific implementation, by providing an included angle between the centerline of the bristle 1 and the axis of the core 2, the bristle 1 is inserted between eyelashes more easily. As the bristle 1 is not perpendicular to the axis of the core 2, a cross section of the whole mascara brush is reduced. While the length of the bristle 1 remains the same, the opening of a mascara bottle is reduced. The mascara brush has the advantages of better application effect, more compact structure and better ease of eyelash combing.

Optionally, the centerline of the bristle 1 is an arc line. Included angles between all the bristles 1 and the axis of the core 2 are identical in a direction. The core 2 is rod-like, with a rectangular side section. The bristle 1 is provided at a first end of the core 2. A fixing mechanism is provided at a second end of the core 2. A cross section of the core 2 is circular or elliptical. In the embodiment, the cross section of the core 2 is circular. A single row of bristles 1 are spaced apart along the axis of the core 2, or multiple rows of bristles 1 are spaced apart along the axis of the core 2 and spaced apart in a tornado-shaped manner along a circumferential direction of the core 2. When there are multiple rows of bristles 1, the bristles 1 are arranged into 14 rows, 16 rows or 18 rows, etc. It is noted that the row number into which the bristles 1 are arranged is an exemplary illustration, rather than a specific limitation to the present disclosure. In the embodiment, there are 16 rows of bristles. Two adjacent rows of bristles 1 are parallel to each other or staggered from each other along the axis of the core 2. In the embodiment, the two adjacent rows of bristles 1 are staggered from each other.

In a specific implementation, by staggering the two adjacent rows of bristles 1 from each other, a better combing effect can be achieved. Optionally, at least two rows of bristles 1 are provided on the core 2, where at least one row of bristles 1 are the bristles 1 formed into the included angles with the axis of the core 2, and centerlines of remaining ones of the bristles 1 are perpendicular to the axis of the core 2.

Optionally, an included angle between the centerline of the bristle 1 and the axis of the core 2 is in a range of greater than 0° to equal or less than 45°, such as 3°, 5°, 8°, 10°, 15°, 30°, 40° or 45°. In the embodiment, the included angle between the centerline of the bristle 1 and the axis of the core 2 is 5°. It is noted that the included angle between the centerline of the bristle 1 and the axis of the core 2 is an exemplary illustration, rather than a specific limitation to the present disclosure.

Optionally, two sides of the same row of bristles 1 are defined as a first side and a second side, respectively. The bristle 1 at the first side and the bristle 1 at the second side are higher than the bristle 1 in a middle. The bristle 1 at the first side is as high as the bristle 1 at the second side, or the bristle 1 at the first side is not as high as the bristle 1 at the second side. In other words, the bristle 1 at the first side has a height of H1, the bristle 1 at the second side has a height of H2, and the bristle 1 in the middle has a height of H3, H1=H2>H3, or H1>H2>H3, or H2>H1>H3.

In the embodiment, the bristle 1 at the first side and the bristle 1 at the second side are higher than the bristle 1 in the middle, and the bristle 1 at the first side is not as high as the bristle 1 at the second side.

In a specific implementation, by providing the bristle 1 at the first side and the bristle at the second side to be higher than the bristle 1 in the middle, and the bristle 1 at the first side to be not as high as the bristle 1 at the second side, the mascara brush can be more suitable for shapes of the eyelashes to achieve the better combing effect. Optionally, centerlines of at least two of the bristles 1 are gathered to one point, or gathered to a circumference of one circle. In the embodiment, the centerlines of at least two of the bristles 1 are gathered to one point.

Optionally, a cross section of the bristle 1 is in at least one of a square shape, a cross shape, an I shape, a petaloid shape, an octagon, a rectangle, a rounded rectangle, a triangle, a convex trapezoid, a concave trapezoid, a circle and an ellipse. It is noted that the cross section of the bristle 1 is an exemplary illustration, rather than a specific limitation to the present disclosure. In the embodiment, the cross section of the bristle 1 is circular.

Optionally, the cross section of the bristle 1 is in a centrosymmetric shape or an axisymmetric shape. In the embodiment, the cross section of the bristle 1 is in the centrosymmetric shape.

Optionally, there are a same cross-sectional shape and a same cross-sectional area or different cross-sectional areas at different heights of the same bristle 1. In the embodiment, the cross section close to the root is greater than that close to the free end for the same bristle 1. In other words, any two cross sections at different heights of the same bristle 1 are identical, or, any two cross sections at different heights of the same bristle 1 are similar.

In a specific implementation, the cross section close to the root is greater than that close to the free end for the same bristle 1, such that the eyelashes can be guided to gaps between the bristles 1 more easily for combing. Optionally, a cross-sectional area of the bristle 1 from the root to a tip is decreased linearly.

In the embodiment, the mascara brush having a tornado-shaped bristle is manufactured by a process including integrated injection molding, such as injection molding, glue injection, or blow molding in a molding cycle. The bristle 1 and the core 2 are formed by integrated injection molding. It is noted that the mascara brush having a tornado-shaped bristle in the embodiment may further be manufactured by another process, which is not limited by the present disclosure.

In the embodiment, the mascara brush having a tornado-shaped bristle is made of a material including plastic or acrylonitrile-butadiene rubber. It is noted that the mascara brush having a tornado-shaped bristle in the embodiment may further be made of another material, which is not limited by the present disclosure.

Embodiment 2

Figure 8:
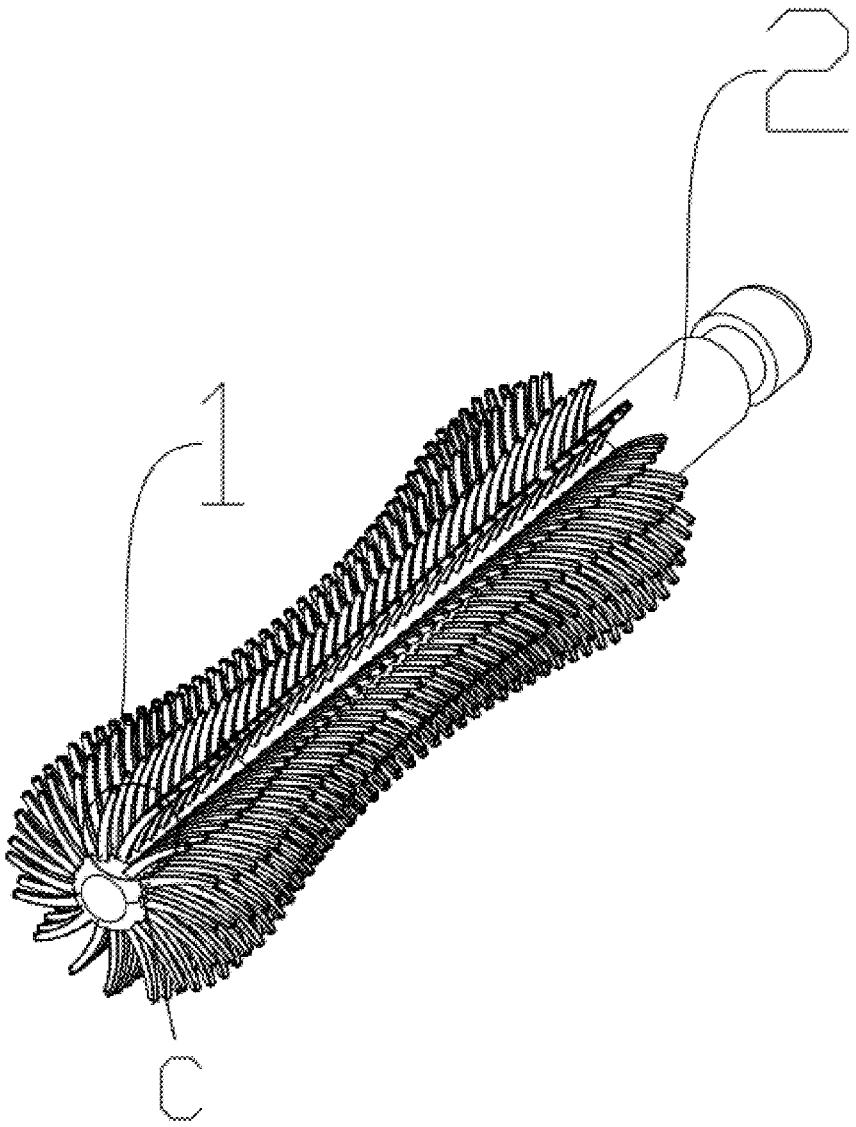
FIG. 8 is a stereoscopic view of a mascara brush having a tornado-shaped bristle according to Embodiment 2 of the present disclosure.
Figure 9:
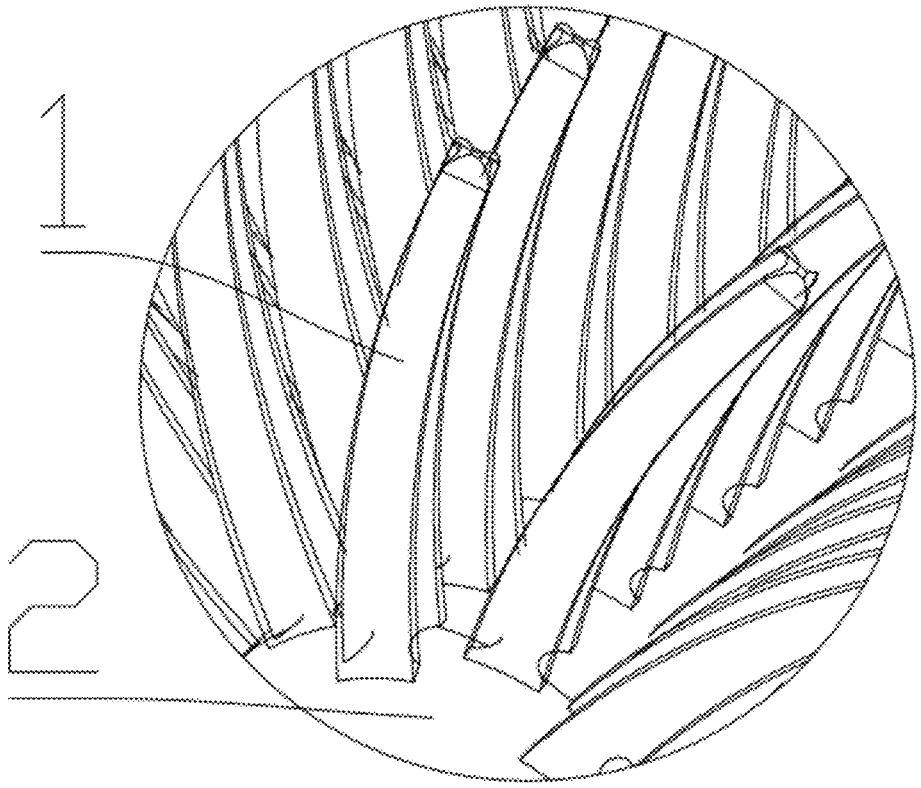
FIG. 9 is an enlarged view of a position C in FIG. 8.
Figure 10:
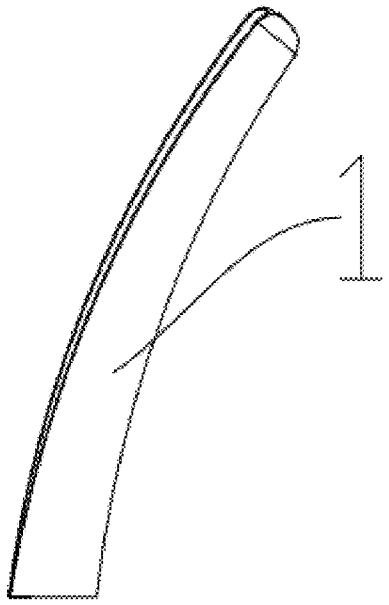
FIG. 10 is a front view of a bristle according to Embodiment 2 of the present disclosure.
Figure 11:
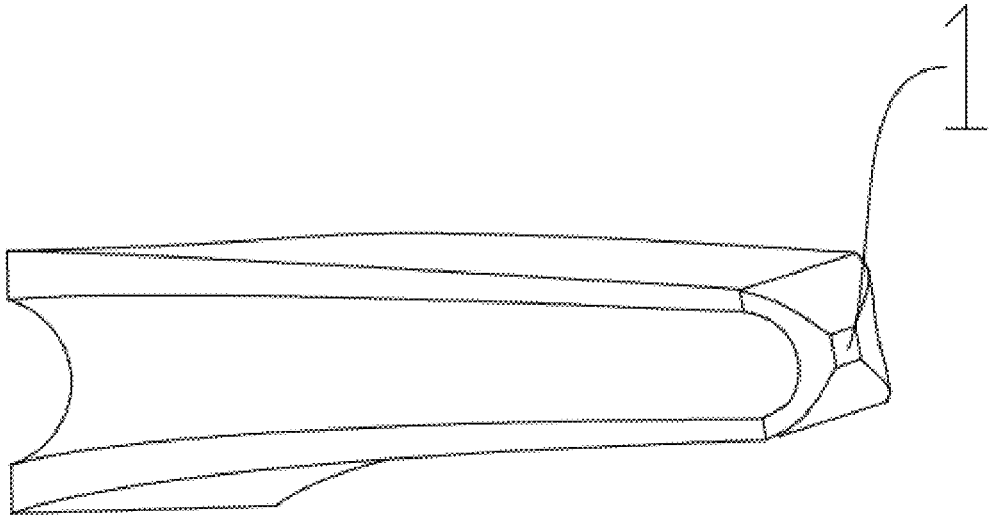
FIG. 11 is a top view of a bristle according to Embodiment 2 of the present disclosure.

As shown in FIGS. 8-11, Embodiment 2 improves upon Embodiment 1. In Embodiment 2, a cross section of the bristle 1 is in at least one of a square shape, a cross shape, an I shape, a petaloid shape, an octagon, a rectangle, a rounded rectangle, a triangle, an ellipse, a convex trapezoid and a concave trapezoid. It is noted that the cross section of the bristle 1 is an exemplary illustration, rather than a specific limitation to the present disclosure. The bristle 1 is twisted along a circumferential direction of its own axis. A twisted angle of the bristle 1 is in a range of (0°, 360° ], such as 30°, 60°, 90°, 180° or 270°. It is noted that the twisted angle of the bristle 1 is an exemplary illustration, rather than a specific limitation to the present disclosure. The bristle 1 is twisted entirely, the free end of the bristle is twisted, the root of the bristle is twisted, the middle portion of the bristle is twisted, or both the free end and the root of the bristle are twisted. It is noted that the twisted position of the bristle 1 is an exemplary illustration, rather than a specific limitation to the present disclosure. In the embodiment, the bristle 1 is twisted entirely.

In a specific implementation, as the bristle 1 is twisted along the circumferential direction of its own axis, the material such as a mascara is better loaded on the bristle 1. Meanwhile, the twisted bristle 1 is more suitable for the eyelashes, such that the eyelashes are attached on the bristle 1 more easily, a larger amount of the material can be dipped at one time, and the material is applied to the eyelashes more easily. Optionally, when the bristle 1 is in any one of the cross shape, the I shape and the octagon, a groove formed by a concave portion on the cross section of the bristle 1 is a spiral groove. In the embodiment, the cross section of the bristle is I-shaped.

In a specific implementation, with the spiral groove, the material can be loaded onto the bristle 1 more easily. Moreover, the eyelashes can also be embedded into the spiral groove for the better application effect.

Optionally, the bristle 1 is twisted clockwise along the circumferential direction of its own axis, or twisted counterclockwise along the circumferential direction of its own axis. In the embodiment, the bristle 1 is twisted counterclockwise along the circumferential direction of its own axis.

Optionally, side edges of the bristle 1 are located at outward protruding junctions between two lines of the cross section of the bristle 1. At least one of the side edges of the bristle 1 is twisted. A twisted angle of the side edge is in a range of (0°, 360° ], such as 30°, 45°, 60°, 90°, 180° or 270°. It is noted that the twisted angle of the side edge is an exemplary illustration, rather than a specific limitation in the present disclosure.

Optionally, all the side edges of the bristle 1 are twisted. Any two of the side edges are twisted in different angles, or any two of the side edges in a centrosymmetry are twisted in a same angle. In the embodiment, any two of the side edges in a centrosymmetry are twisted in a same angle.

The foregoing embodiments are preferred embodiments of the present disclosure and are described in detail with reference to the accompanying drawing. Various modifications or changes made by those skilled in the art to the above embodiments should fall within the protection scope of the present disclosure without departing from the essence of the present disclosure.

What is claimed is:

1. A mascara brush, comprising:

at least one bristle and a core, wherein a root of the at least one bristle is provided on the core, and a free end of the at least one bristle is provided away from the core; and a centerline of the at least one bristle intersects with a longitudinal axis of the core in a non-perpendicular manner, wherein the at least one bristle has a helical profile such that the centerline of the at least one bristle spirals around and extends along the longitudinal axis of the core, with the bristle centerline forming a continuous helical path about the longitudinal axis of the core and wherein the at least one bristle is integrally formed with the core, and wherein an angle between the centerline of the at least one bristle and the longitudinal axis of the core is in a range from greater than 15° to less than or equal to 45°, measured as the acute angle between the tangent to the helical centerline at the root and the longitudinal axis of the core, and wherein the mascara brush further includes a fixing mechanism on a first side of the core, the fixing mechanism being integrally formed with the core and configured for attachment to a handle, wherein a cross section of the at least one bristle is in at least one selected from the group consisting of a petaloid shape, an octagon, a rounded rectangle, a triangle, a convex trapezoid, a concave trapezoid, and a circle.

2. The mascara brush according to claim 1, wherein:

the centerline of the at least one bristle is an arc line;

angles between all the bristles and the longitudinal axis of the core are identical in a direction;

the core is rod-like;

wherein the at least one bristle comprises a single row of bristles spaced apart along the longitudinal axis of the core, or multiple rows of bristles spaced apart along the longitudinal axis of the core and spaced apart in a helical-shaped manner along a circumferential direction of the core; and two adjacent rows of bristles are parallel to each other, or two adjacent rows of bristles are staggered from each other along the longitudinal axis of the core.

3. The mascara brush according to claim 2, wherein:

the at least one bristle comprises at least two rows of bristles provided on the core, wherein at least one row of bristles are the bristles formed into the angles with the longitudinal axis of the core.

4. The mascara brush according to claim 3, wherein the cross section of the at least one bristle is in at least one selected from the group consisting of a petaloid shape, an octagon, a convex trapezoid, a concave trapezoid, and a circle.

5. The mascara brush according to claim 2, wherein two sides of a same row of bristles are defined as a first side and a second side, respectively; and the bristle at the first side has a height of H1, the bristle at the second side has a height of H2, and the bristle in a middle of the first side and the second side has a height of H3, wherein H1=H2>H3, or H1>H2>H3, or H2>H1>H3.

6. The mascara brush according to claim 5, wherein the cross section of the at least one bristle is in at least one selected from the group consisting of a petaloid shape, an octagon, a convex trapezoid, a concave trapezoid, and a circle.

7. The mascara brush according to claim 2, wherein centerlines of at least two of the bristles are gathered to one point, or gathered to a circumference of one circle.

8. The mascara brush according to claim 2, wherein the cross section of the at least one bristle is in at least one selected from the group consisting of a petaloid shape, an octagon, a convex trapezoid, a concave trapezoid, and a circle.

9. The mascara brush according to claim 1, wherein the cross section of the at least one bristle is in at least one selected from the group consisting of a petaloid shape, an octagon, a rounded rectangle, a convex trapezoid, and a concave trapezoid; the at least one bristle is curved or twisted along a circumferential direction of an axis of the at least one bristle; and at least one of the free end, the root, or a middle portion of the at least one bristle is curved or twisted.

10. The mascara brush according to claim 9, wherein when the cross section of the at least one bristle is octagonal, a groove formed by a concave portion on the cross section of the at least one bristle is a spiral groove.

11. The mascara brush according to claim 9, wherein cross-sectional shapes at different heights of the same bristle are identical or similar.

12. The mascara brush according to claim 9, wherein the cross section of the at least one bristle is in a centrosymmetric shape or an axisymmetric shape.

13. The mascara brush according to claim 9, wherein a cross-sectional area of the at least one bristle from the root to a tip is decreased linearly.

14. The mascara brush according to claim 9, wherein the at least one bristle is curved clockwise along the circumferential direction of the longitudinal axis of the at least one bristle, or the at least one bristle is curved counterclockwise along the circumferential direction of the longitudinal axis of the at least one bristle.

15. The mascara brush according to claim 9, wherein side edges of the at least one bristle are located at outward protruding junctions between two lines of the cross section of the at least one bristle; and at least one of the side edges of the at least one bristle is curved.

16. The mascara brush according to claim 15, wherein all the side edges of the at least one bristle are curved; any two of the side edges are curved in different angles; or any two of the side edges in a centrosymmetry are curved in a same angle.

17. The mascara brush according to claim 1, wherein the at least one bristle and the core are formed by integrated injection molding.

* * * * *